US007501975B2

(12) United States Patent
Konno

(10) Patent No.: US 7,501,975 B2
(45) Date of Patent: Mar. 10, 2009

(54) REMOTE CONTROLLER, COMMAND TRANSMISSION METHOD, COMMAND RECEIVING APPARATUS AND PERSONAL COMPUTER APPARATUS

(75) Inventor: Ryo Konno, Tochigi (JP)

(73) Assignee: Sony Corporation, Tokyo (JP)

( * ) Notice: Subject to any disclaimer, the term of this patent is extended or adjusted under 35 U.S.C. 154(b) by 257 days.

(21) Appl. No.: 11/441,170

(22) Filed: May 26, 2006

(65) Prior Publication Data

US 2007/0001894 A1 Jan. 4, 2007

(30) Foreign Application Priority Data

May 3, 2005 (JP) ..... 2005-157457

(51) Int. Cl.
*G08C 17/00* (2006.01)

(52) U.S. Cl. ..... 341/176; 340/825.69

(58) Field of Classification Search ..... 341/176; 340/825.69

See application file for complete search history.

(56) References Cited

U.S. PATENT DOCUMENTS 5,737,107 A * 4/1998 Umeda ..... 398/106
6,567,016 B1 * 5/2003 Rajamani et al. ..... 341/24

* cited by examiner

*Primary Examiner*—Albert K Wong
*Assistant Examiner*—Hung Q Dang
(74) *Attorney, Agent, or Firm*—Finnegan, Henderson, Farabow, Garrett & Dunner, L.L.P.

(57) ABSTRACT

A remote controller detects an ON state or an OFF state of operation of pushing a remote controller key 2. When the detection result is the ON state, the remote controller generates a predetermined ON code S3 previously allocated to the remote controller key 2. When the detection result is the OFF state after it shows the ON state, the remote controller generates an OFF code S4 representing the OFF state, generates a transmission command by adding the OFF code S4 to the ON code S3, and then transmits the transmission command to a target command receiver. Therefore, the receiver can correctly recognize the contents of the transmission command S5 generated at the remote controller by detecting the OFF code S4. That is to say, the receiver can recognize the contents of the pushing operation of the remote controller key 2.

3 Claims, 9 Drawing Sheets

ALTHOUGH THE CODES NEATLY CONTINUE ONE AFTER ANOTHER, OFF CODES ALLOW COMPUTERS TO RECOGNIZE THAT THE KEY WAS PUSHED TWICE.

ALTHOUGH THE CODES NEATLY CONTINUE ONE AFTER ANOTHER, OFF CODES ALLOW COMPUTERS TO RECOGNIZE THAT THE KEY WAS PUSHED TWICE.

ALTHOUGH THE INTERVAL IS LESS OR EQUAL TO 100 MSEC, OFF CODES ALLOW COMPUTERS TO RECOGNIZE THAT THE KEY WAS PUSHED TWICE.

REMOTE CONTROLLER, COMMAND TRANSMISSION METHOD, COMMAND RECEIVING APPARATUS AND PERSONAL COMPUTER APPARATUS

CROSS REFERENCES TO RELATED APPLICATIONS

The present invention contains subject matter related to Japanese Patent Application JP2005-157457 filed in the Japanese Patent Office on May 30, 2005, the entire contents of which being incorporated herein by reference.

BACKGROUND OF THE INVENTION

1. Field of the Invention

The preset invention relates to a remote controller, command transmission method, command receiving apparatus and personal computer apparatus, and, for example, is preferably applied to a remote controller that generates, in response to a pushing operation of a key, a transmission command and then transmits the transmission command.

2. Description of Related Art

In late years, it has become common practice to enjoy music and television programs on a personal computer, and a user uses an infrared remote controller and a Radio Frequency (RF) remote controller to handle music and television programs on the personal computer in the same way as television sets.

As shown in FIG. 1, the reference numeral 1 denotes a general infrared remote controller as a whole. An ON/OFF detection section 3 detects a pushing operation where a user pushes a remote controller key 2 disposed on a surface of a body (not shown).

While the remote controller key 2 is being pushed, the ON/OFF detection section 3 detects an ON state. The ON/OFF detection section 3 detects an OFF state, when the pushing operation of the remote controller key 2 stops. The ON/OFF detection section 3 then supplies these detection results to an ON code generation section 4.

When the detection result from the ON/OFF detection section 3 shows the ON state, the ON code generation section 4 generates at least three ON codes having a predetermined number of bits for each ON state. The ON code generation section 4 then supplies these ON codes to a modulation section 5.

The modulation section 5 modulates the three ON codes in a predetermined modulation manner. The modulation section 5 then supplies the modulated signals to a infrared transmission section 6 which then transmits the modulated signals to an infrared receiving section of a personal computer (not shown) as infrared signals.

As shown in FIG. 2, when the ON code generation section 4 detects the ON state in which one pushing operation of the remote controller key 2 is performed, the ON code generation section 4 transmits three continuous ON codes of the same pulse at intervals of approximately 50 msec by infrared radiation as a transmission command. Therefore, the ON code generation section 4 can certainly transmit the ON codes to the infrared receiving section of the personal computer, and this improves the reliability.

As shown in FIG. 3, while the ON code generation section 4 is detecting the ON state in which one pushing operation of the remote controller key 2 is performed for a long time, the ON code generation section 4 transmits continuous ON codes of the same pulse at intervals of approximately 50 msec by infrared radiation as a transmission command (The ON code generation section 4 transmits six continuous ON codes while the remote controller key 2 is being pushed, in this case).

Generally, if the remote controller key 2 is assigned to volume control, the continuous pushing operation of the remote controller key 2 is often performed. The longer the remote controller key 2 is pushed the more same size ON codes (nine, twelve, and more, for example) the ON code generation section 4 continuously transmits by infrared radiation as a transmission command.

As shown in FIG. 4, when the ON code generation section 4 detects that the remote controller key 2 is pushed twice within a very short period of time like double click, the ON code generation section 4 transmits six continuous ON codes, equivalent to two sets of three continuous ON codes of the same pulse at intervals of approximately 50 msec, by infrared radiation as transmission commands, although the key operation was performed twice. It is because the time between the first key operation and the second key operation is very short. As a result, the transmission commands are the same as the one having six ON codes as shown in FIG. 2, which are transmitted when the remote controller key is pushed for a long time.

This phenomenon is caused by performing the second key operation before the transmission of the transmission command (having three ON codes) corresponding to the first key operation is completed. That is to say, to improve the reliability, the more ON codes the ON code generation section 4 transmits for each key operation, the longer a user waits for the second key operation after the first key operation. The relationship between improvement of reliability and improvement of operationality is a trade-off.

As shown in FIG. 5, when a user pushes the remote controller key 2 such that the time between the first key operation and the second key operation is longer than double click (i.e., the user performs the second key operation after the transmission of the transmission command (having three ON codes) corresponding to the first key operation is completed), the ON code generation section 4 waits for some time to transmit the transmission command (having three ON codes) corresponding to the second key operation after completing the transmission of the transmission command (having three ON codes) corresponding to the first key operation.

The infrared receiving section of the personal computer, a receiver of the transmission command, accepts the received transmission command as valid, when the received transmission command includes two continuous ON codes of the same pulse within a period of 100 msec.

Accordingly, as shown in FIG. 5, even when the personal computer receives two transmission commands by the infrared receiving section, the personal computer mistakenly accepts them as one transmission command, since the reception interval between the last ON code in the transmission command corresponding to the first key operation and the first ON code in the transmission command corresponding to the second key operation is within a period of 100 msec.

Specifically, as shown in FIG. 6, the personal computer performs code determination process (routine RT1) to determine validity of the transmission command. The personal computer starts to perform the routine RT1 at start step, and then proceeds to next step SP1.

At step SP1, when the personal computer receives from the infrared remote controller 1 an infrared signal by the infrared receiving section, the personal computer proceeds to next step SP2. At step SP2, the personal computer demodulates and decodes the infrared signal to generate a reception command corresponding to the transmission command generated by the infrared remote controller 1. The personal computer then proceeds to next step SP3.

At step SP3, the personal computer controls a timer counter (not shown) to determine whether to detect two continuous ON codes within a period of 100 msec out of a plurality of ON codes making up the reception command. When negative result is obtained at step SP3, the personal computer proceeds to next step SP4.

At step SP4, since the interval between the ON codes, which make up the reception command, is more than 100 msec, the personal computer accepts the reception command as an OFF state, and then proceeds to next step SP7 without performing any process. The personal computer then ends the process.

By contrast, in a case in which the personal computer obtains affirmative result at step SP3 and also obtains two codes of the same pulse within a code-reception period of 100 msec, the personal computer then proceeds to next step SP5. In a case in which the personal computer obtains two codes of different pulses within the code-reception period of 100 msec, the personal computer then proceeds to next step SP6.

At step SP5, since the personal computer receives two continuous ON codes within the period of 100 msec out of the three ON codes making up the reception command, the personal computer accepts the reception command as valid, and then performs predetermined validity code process. The personal computer then proceeds to next step SP7 to end the process.

At step SP6, the personal computer accepts the reception command as invalid, because the first ON code and the second ON code are different in spite of receiving the two codes within the period of 100 msec. Accordingly, the personal computer performs code invalidity process, and then proceeds to next step SP7 to end the process.

In this manner, when the personal computer receives continuous ON codes of the same pulse within the period of 100 msec, the personal computer accepts the reception command as valid. Accordingly, when the interval between the last ON code in the transmission command corresponding to the first key operation and the first ON code in the transmission command corresponding to the second key operation is less or equal to 100 msec, the personal computer mistakenly recognizes the received transmission commands as one command including six ON codes generated by pushing the remote controller key 2 for a long time as shown in FIG. 3, in spite of the key operation performed twice at the infrared remote controller 1.

In order to solve the problem, there is an infrared remote controller device that allows a remote controller receiver to correctly recognize continuous key operation of the remote controller key 2 on the infrared remote controller (see Japanese Patent Laid-Open Publication No. 2003-3486762, for example).

SUMMARY OF THE INVENTION

By the way, the infrared remote controller device with the above configuration utilizes remote-controller output having a data section including a remote controller key's key code and additional key-ON/OFF information. Therefore, a user cannot use the infrared remote controller device together with a general remote controller receiver which can recognize only remote-controller output with no key-ON/OFF information. In this manner, the infrared remote controller device is incompatible with the general remote controller receiver, and therefore is not easy to use.

The present invention has been made in view of the above points and is intended to provide a remote controller and command transmission method capable of correctly communicating information about the number of key operations corresponding to transmission commands to a receiver, and ensuring compatibility with general command receiver. The present invention is also intended to provide a command receiving apparatus and personal computer apparatus capable of correctly recognizing contents of the key operations based on the transmission commands.

In an embodiment of the present invention, a remote controller includes: a detection section for detecting an ON state or an OFF state of operation of a key; an ON code generation section for generating a predetermined ON code previously allocated to the key when the detection section detects the ON state as a detection result; an OFF code additional generation section for generating an OFF code representing the OFF state when the detection section detects the OFF state as a detection result after detecting the ON state, and then generating a transmission command by adding the OFF code to the ON code; and a transmission section for transmitting the transmission command to a target command receiver.

In this manner, if the OFF state is detected after the ON state, the OFF code representing the OFF state is added to the usual ON code to generate the transmission command. Therefore, the receiver can correctly recognize how many times the transmission-side's key was operated by detecting the OFF code in the transmission command. In addition, the ON code in this transmission command is the same as that of the general transmission command. Therefore, a general command receiver can recognize the ON code at least. This ensures compatibility with the general command receiver.

In addition, in an embodiment of the present invention, a command transmission method includes: a detection step of detecting an ON state or an OFF state of operation of a key; an ON code generation step of generating a predetermined ON code previously allocated to the key when the detection step detects the ON state as a detection result; an OFF code additional generation step of generating an OFF code representing the OFF state when the detection step detects the OFF state as a detection result after detecting the ON state, and then generating a transmission command by adding the OFF code to the ON code; and a transmission step of transmitting the transmission command to a target command receiver.

In this manner, if the OFF state is detected after the ON state, the OFF code representing the OFF state is added to the usual ON code to generate the transmission command. Therefore, the receiver can correctly recognize how many times the transmission-side's key was operated by detecting the OFF code in the transmission command. In addition, the ON code in this transmission command is the same as that of the general transmission command. Therefore, a general command receiver can recognize the ON code at least. This ensures compatibility with the general command receiver.

Furthermore, in an embodiment of the present invention, a command receiving apparatus includes: a receiving section for receiving from a remote controller a transmission command generated by adding a predetermined OFF code to a plurality of continuous ON codes of the same form; a reception interval measurement section for measuring a code-reception interval, the code-reception interval including an interval between the plurality of continuous ON codes of the same form and an interval between the ON code and the OFF code; a determination section for determining whether or not the code-reception interval is within a predetermined criterion time; a command content recognition section for recognizing the transmission command as an OFF state if a determination result by the determination section shows that the code-reception interval is out of the criterion time, recognizing the transmission command as an ON state if the determination result by the determination section shows that the code-reception interval is within the criterion time and two continuous codes are the same kind of the ON code, and recognizing the transmission command as the OFF state if the determination result by the determination section shows that the code-reception interval is within the criterion time and two continuous codes are the ON code and subsequent the OFF code.

In this manner, if the code-reception interval is within the criterion time and two continuous codes are different from each other, the command receiving apparatus detects the OFF state as key operation, which is to say the command receiving apparatus distinguishes first key operation from second one. Thus, the command receiving apparatus can correctly recognize continuous key operations and separate key operations.

In an embodiment of the present invention, if the OFF state is detected after the ON state, the OFF code representing the OFF state is added to the usual ON code to generate the transmission command. Therefore, the receiver can correctly recognize how many times the transmission-side's key was operated by detecting the OFF code in the transmission command. In addition, the ON code in this transmission command is the same as that of the general transmission command. Therefore, a general command receiver can recognize the ON code at least. This ensures compatibility with the general command receiver. Thus, the remote controller and command transmission method according to an embodiment of the present invention can correctly communicate information about the number of key operations corresponding to transmission command to a receiver, and ensures compatibility with a general command receiver.

In addition, in an embodiment of the present invention, if the code-reception interval is within the criterion time and two continuous codes are different from each other, the command receiving apparatus detects the OFF state as key operation, which is to say the command receiving apparatus distinguishes first key operation from second one. Therefore, the command receiving apparatus can correctly recognize continuous key operations and separate key operations. Thus, the command receiving apparatus can correctly recognize the number of key operations corresponding to the transmission command.

The nature, principle and utility of the invention will become more apparent from the following detailed description when read in conjunction with the accompanying drawings in which like parts are designate by like reference numerals or characters.

DETAILED DESCRIPTION OF PREFERRED EMBODIMENTS

An embodiment of the present invention will be described in detail with reference to the accompanying drawings.

(1) Configuration of Infrared Remote Controller

Figure 1:
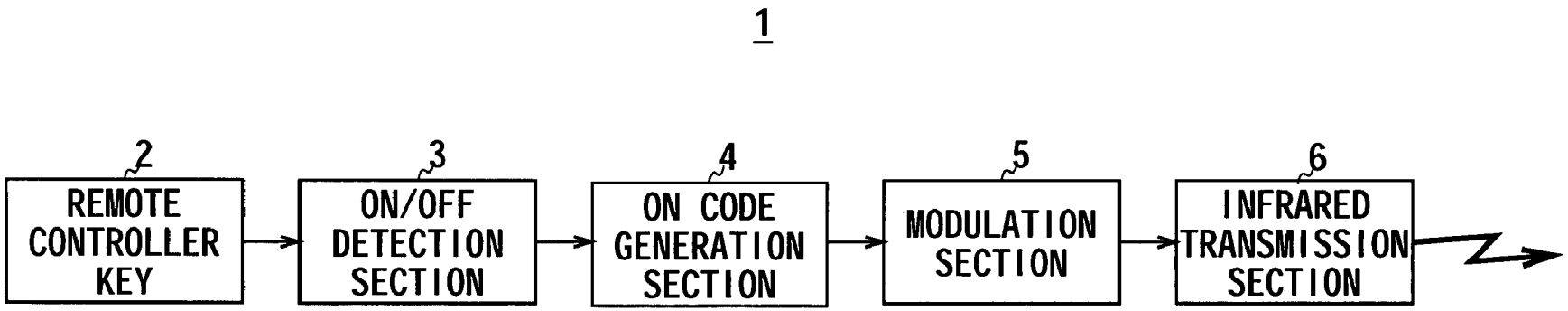
FIG. 1 (PRIOR ART)
FIG. 1 is a schematic block diagram showing the configuration of a general infrared remote controller.
Figure 2:
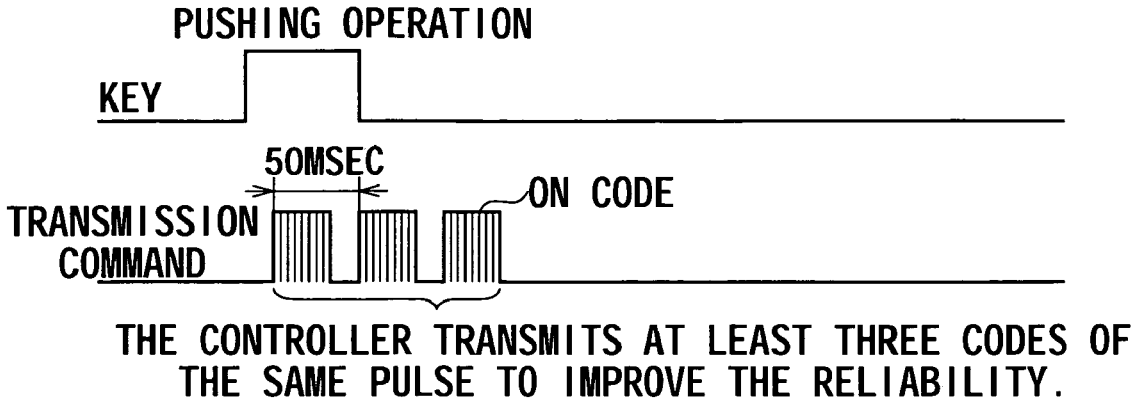
FIG. 2 (PRIOR ART)
FIG. 2 is a schematic diagram illustrating a transmission command generated when short-time operation of pushing a remote controller key is performed once.
Figure 3:
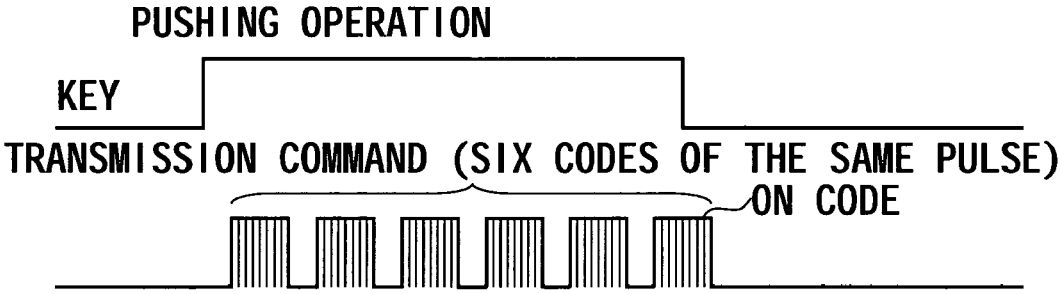
FIG. 3 (PRIOR ART)
FIG. 3 is a schematic diagram illustrating a transmission command generated when long-time operation of pushing a remote controller key is performed once.
Figure 4:
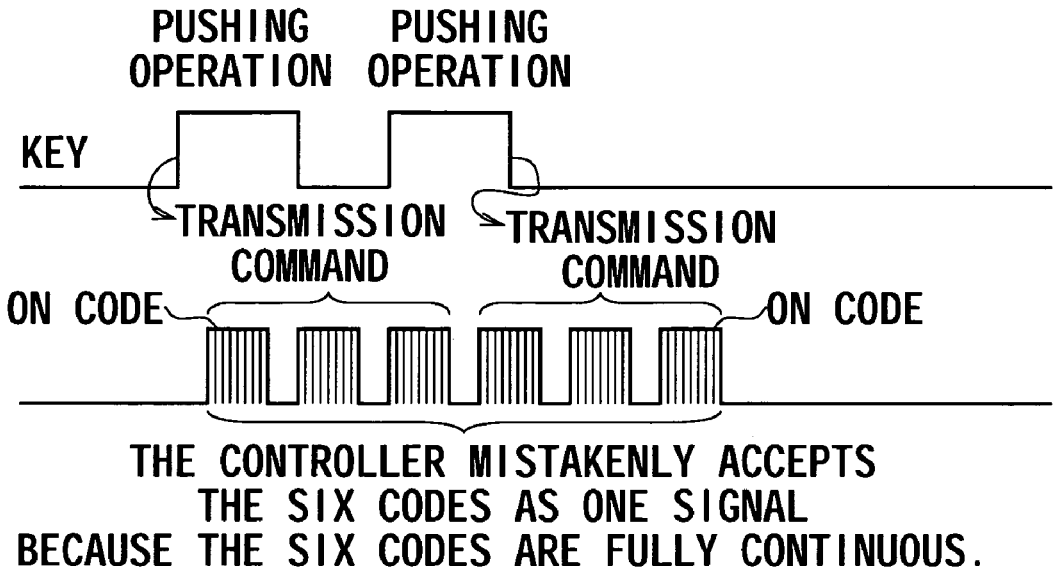
FIG. 4 (PRIOR ART)
FIG. 4 is a schematic diagram illustrating transmission commands generated when operation of pushing a remote controller key is performed twice within a short period of time.
Figure 5:
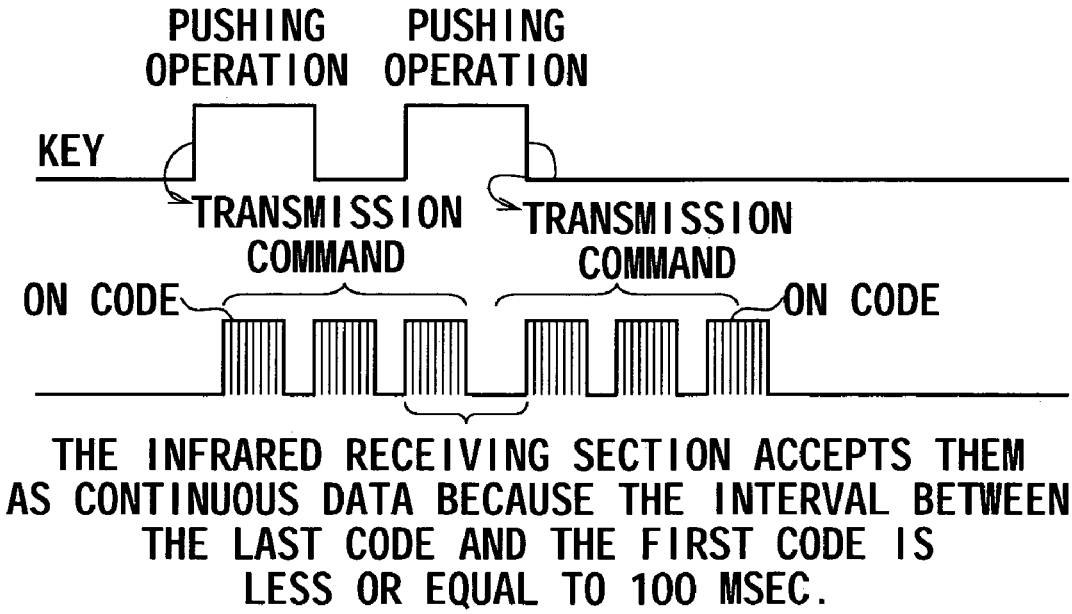
FIG. 5 (PRIOR ART)
FIG. 5 is a schematic diagram illustrating transmission commands generated when operation of pushing a remote controller key is performed twice within a slightly short period of time.
Figure 6:
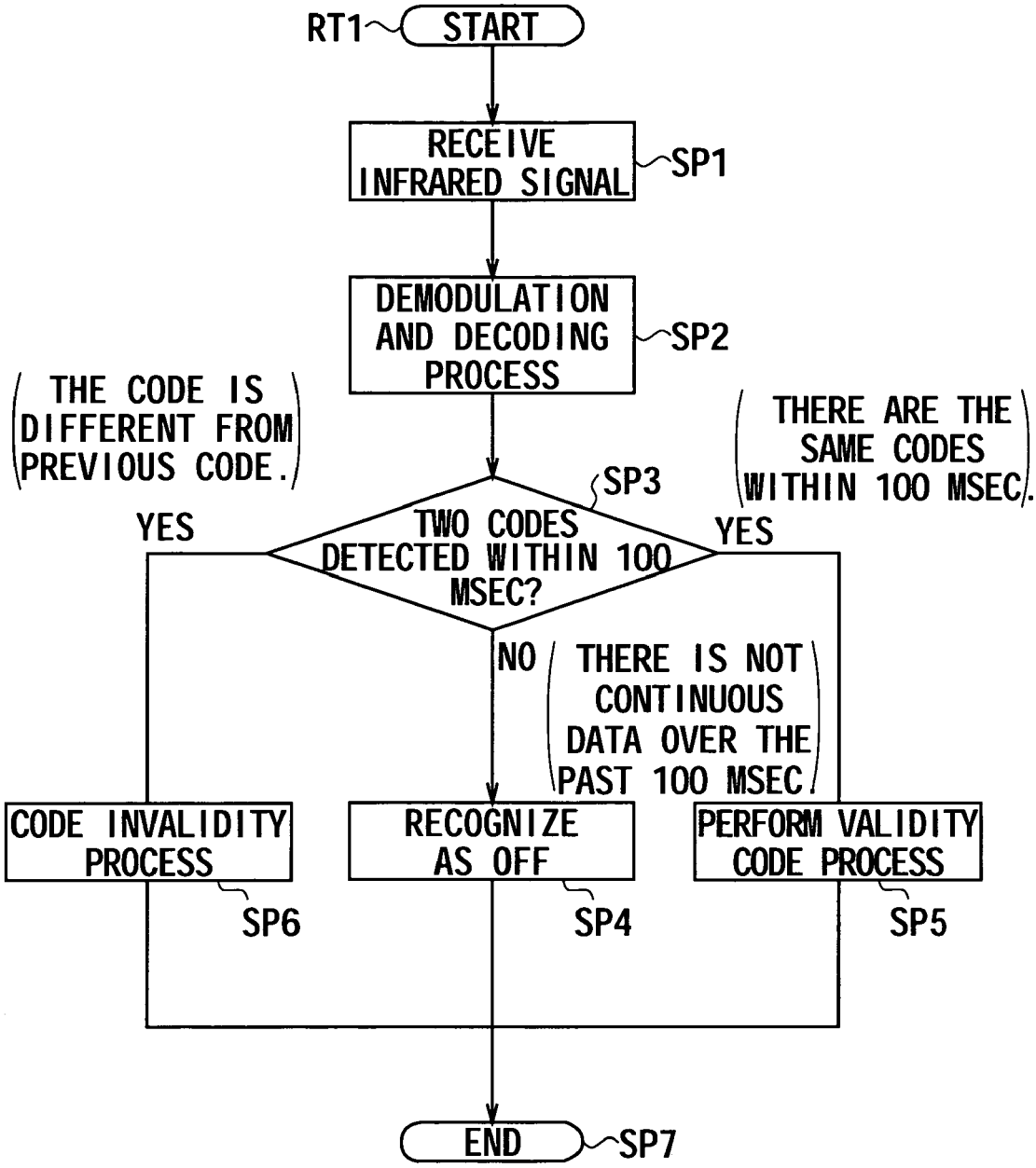
FIG. 6 (PRIOR ART)
FIG. 6 is a flowchart illustrating a general code determination process.
Figure 7:
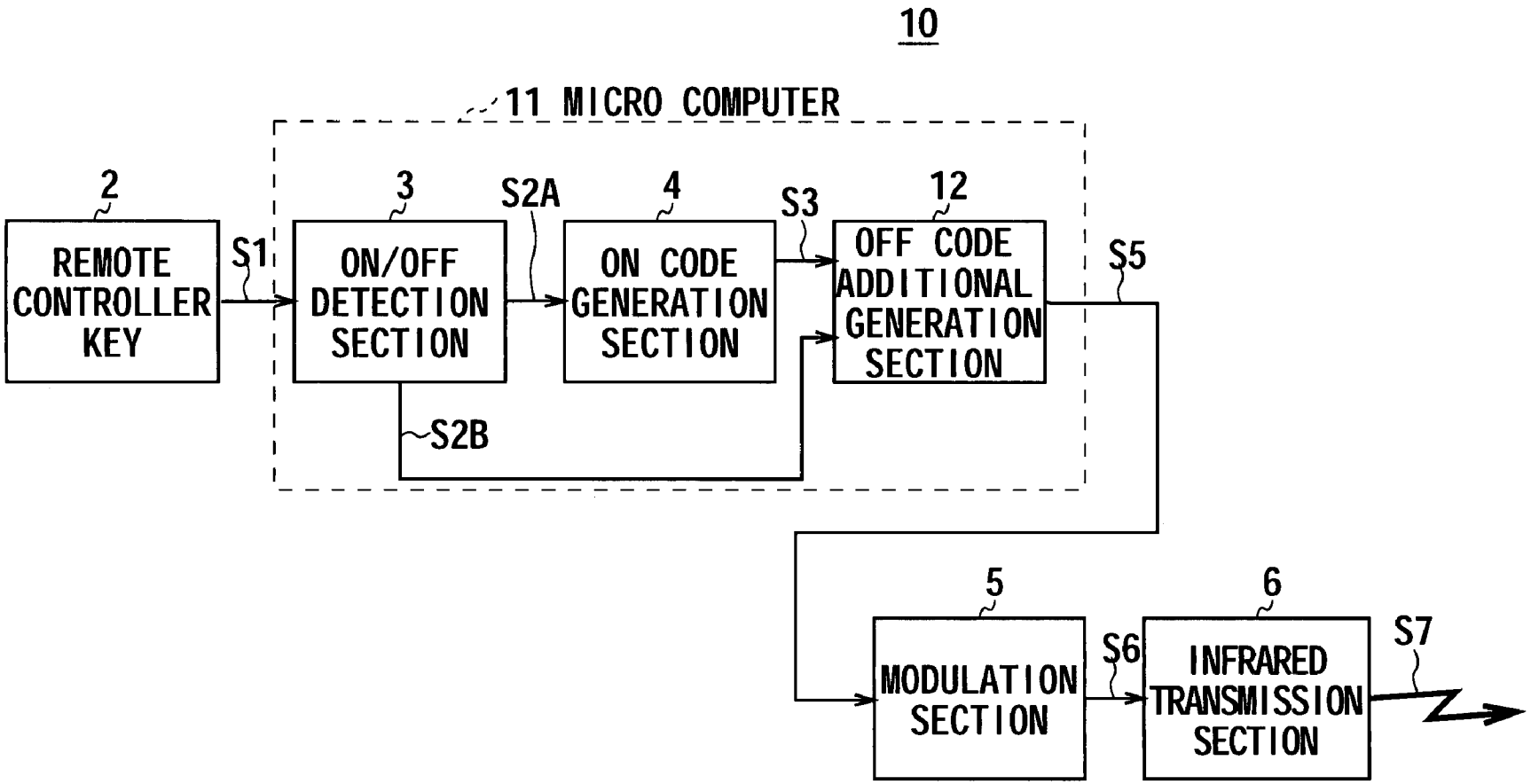
FIG. 7 is a schematic block diagram showing the configuration of an infrared remote controller according to an embodiment of the present invention.
Figure 12:
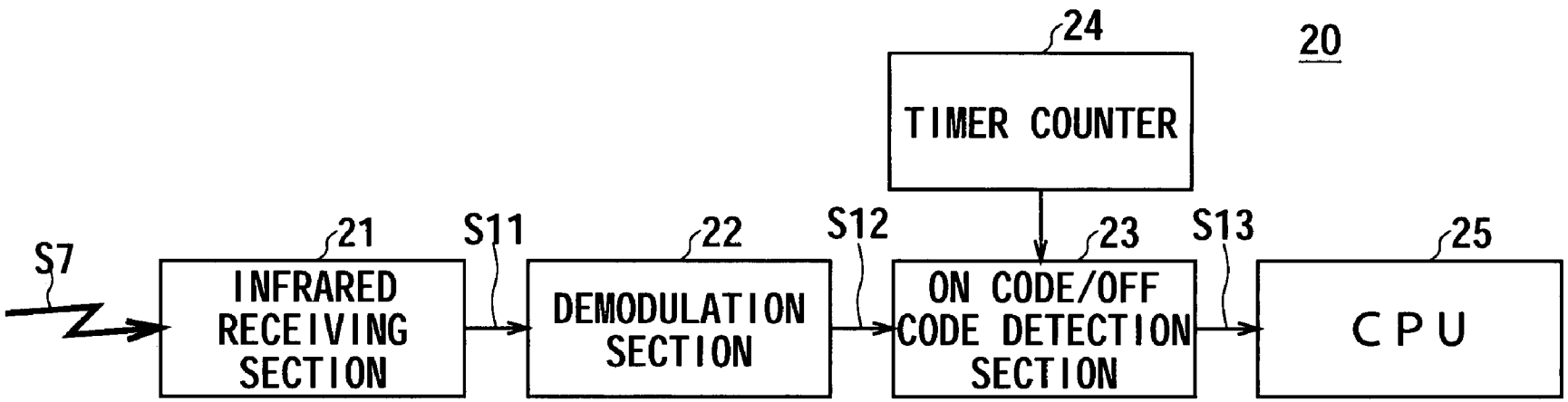
FIG. 12 is a schematic block diagram showing the configuration of an infrared receiving section.

In FIG. 7, the reference numeral 10 denotes an infrared remote controller according to an embodiment of the present invention. The parts of FIG. 7 have been designated by the same reference numerals and marks as the corresponding parts of FIG. 1. The infrared remote controller 10 transmits an infrared signal S7 to an infrared receiving section 20 of a personal computer described below (FIG. 12).

The infrared remote controller 10 utilizes an ON/OFF detection section 3, which is part of a micro computer 11, to detect that a user pushes a remote controller key 2 disposed on a surface of a body (not shown).

Based on a key signal S1 which is supplied from the remote controller key 2 during the pushing operation of the remote controller key 2, the ON/OFF detection section 3 detects an ON state, and then supplies to an ON code generation section 4 a detection result S2A showing the ON state.

The remote controller key 2 stops supplying the key signal S1 when the pushing operation of the remote controller key 2 ends. In response to that, the ON/OFF detection section 3 detects an OFF state, and then supplies to an OFF code additional generation section 12 a detection result S2B showing the OFF state.

Based on the detection result S2A from the ON/OFF detection section 3, the ON code generation section 4 generates at least three ON codes S3 having a predetermined number of bits (three bits, for example), and then supplies the ON codes S3 to the OFF code additional generation section 12.

Based on the detection result S2B from the ON/OFF detection section 3, the OFF code additional generation section 12 generates one OFF code S4 (not shown) having a predetermined number of bits (twenty bits, for example) which differs from that of the three ON codes S3 generated by the ON code generation section 4. The OFF code additional generation section 12 adds the OFF code S4 to the three ON codes S3 supplied from the ON code generation section 4 to generate a transmission command S5 in which the three ON codes S3 and the one OFF code S4 continuously appear at intervals of approximately 50 msec. The OFF code additional generation section 12 then supplies the transmission command S5 to a modulation section 5.

By the way, the OFF code additional generation section 12 generates the OFF code S4 when receiving the detection result S2B from the ON/OFF detection section 3. That is to say, after a remote controller key of the remote controller key 2 is pushed for a long time, the OFF code additional generation section 12 adds the one OFF code S4 to the plurality of ON codes S3 continuously generated by the ON code generation section 4 to generate the transmission command S5 in which the plurality of ON codes S3 and the one OFF code S4 continuously appear. The OFF code additional generation section 12 then supplies the transmission command S5 to the modulation section 5.

The modulation section 5 modulates the transmission command S5 in a predetermined modulation manner, and then supplies the resulting modulated signal S6 to an infrared transmission section 6. The infrared transmission section 6 transmits the modulated signal S6 to the infrared receiving section 20 of the personal computer (FIG. 12) as the infrared signal S7 by infrared radiation.

By the way, the ON/OFF detection section 3, the ON code generation section 4 and the OFF code additional generation section 12 are functional blocks that the micro computer 11 runs by activating a predetermined transmission command generation program stored in a Read Only Memory (ROM). In fact, the micro computer 11 generates the transmission command S5 by software.

Figure 8:
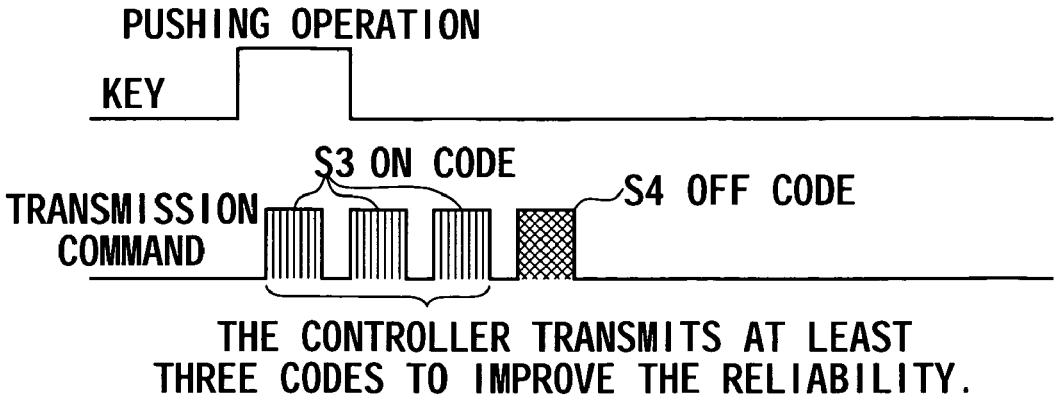
FIG. 8 is a schematic diagram illustrating a transmission command generated when short-time operation of pushing a remote controller key is performed once.

(2) Contents of Transmission Command (2-1) Transmission Command Generated When Short-Time Operation of Pushing Remote Controller Key is Performed Once As shown in FIG. 8, the transmission command S5, which is generated based on the detection results S2A and S2B supplied from the ON/OFF detection section 3 when the remote controller key 2 is pushed just once, includes one OFF code S4 after the three ON codes S3 supplied from the ON code generation section 4. Therefore, three ON codes S3 and one OFF code S4 are transmitted one after another at intervals of approximately 50 msec.

In this manner, based on the detection result S2A from the ON/OFF detection section 3, the micro computer 11 certainly generates three ON codes S3. This prevents information loss across infrared-wireless-transmission paths, and improves the reliability. In addition, it is possible for the personal computer to certainly recognize that the remote controller key 2 has been pushed once, based on the one OFF code S4 coming after the three ON codes S3.

Figure 9:
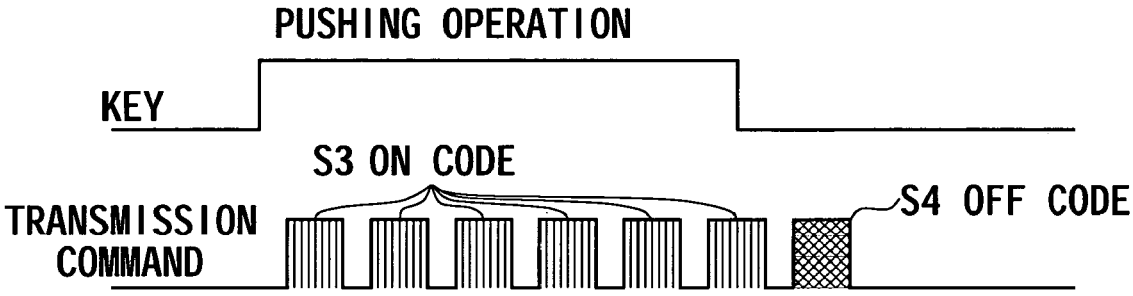
FIG. 9 is a schematic diagram illustrating a transmission command generated when long-time operation of pushing a remote controller key is performed once.

(2-2) Transmission Command Generated When Long-Time Operation of Pushing Remote Controller Key is Performed Once As shown in FIG. 9, the transmission command S5, which is generated based on the detection results S2A and S2B supplied from the ON/OFF detection section 3 when the remote controller key 2 is pushed just once for a long time, includes one OFF code S4 after the plurality of ON codes S3 (six codes, in this case) continuously generated at intervals of approximately 50 msec during the pushing operation of the remote controller key 2. Therefore, six ON codes S3 and one OFF code S4 are transmitted one after another at intervals of approximately 50 msec.

In this manner, the transmission command S5 in which six ON codes S3 and one OFF code S4 continuously appear certainly has the OFF code S4 at the end. Therefore, it is possible for the personal computer to certainly recognize that the continuous pushing operation of the remote controller key 2 has been completed, based on the OFF code S4 coming after the six ON codes S3.

Figure 10:
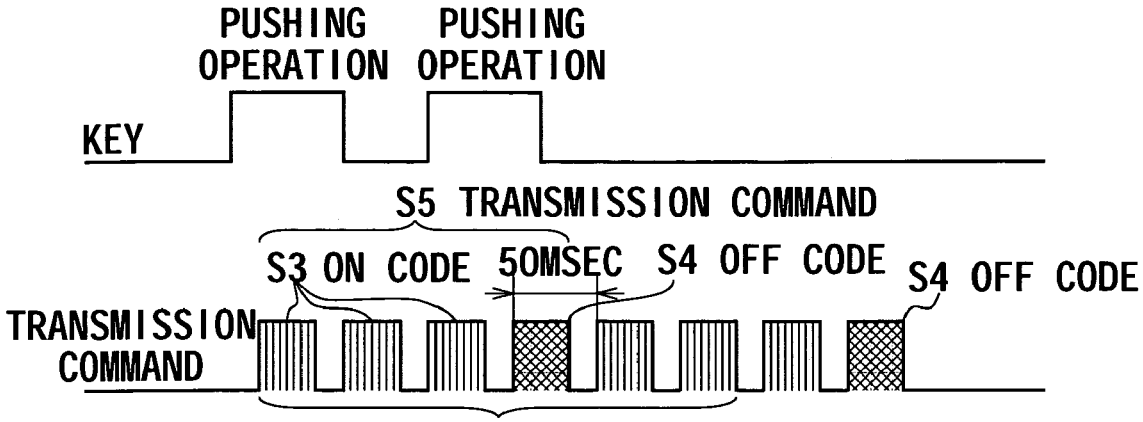
FIG. 10 is a schematic diagram illustrating transmission commands generated when operation of pushing a remote controller key is performed twice within a short period of time.

(2-3) Transmission Commands Generated When Operation of Pushing Remote Controller Key is Performed Twice Within a Short Period of Time As shown in FIG. 10, in a case in which first pushing operation of the remote controller key 2 generates a first transmission command S5 based on the detection results S2A and S2B from the ON/OFF detection section 3; and then second pushing operation of the remote controller key 2 generates a second transmission command S5 based on the detection results S2A and S2B from the ON/OFF detection section 3 before the transmission of the first transmission command S5 is completed, the second transmission command S5 corresponding to the second pushing operation of the remote controller key 2 comes immediately after the first transmission command S5 corresponding to the first pushing operation of the remote controller key 2.

In this case, even if the interval between the OFF code S4 in the first transmission command S5 and the first ON code S3 in the second transmission command S5 is for example 50 msec, the personal computer (a receiver of the transmission command) detects the OFF code S4 in the first transmission command S5 and subsequently detects the OFF code S4 in the second transmission command S5. This allows the personal computer to correctly recognize two transmission commands S5 transmitted from the infrared remote controller 10.

For example, a user pushes the remote controller key 2 twice within a short period of time in that manner when performing skipping operation to select music or performing key operation to select items. The personal computer can certainly and correctly recognize that the remote controller key 2 has been repeatedly pushed for a short period of time.

Figure 11:
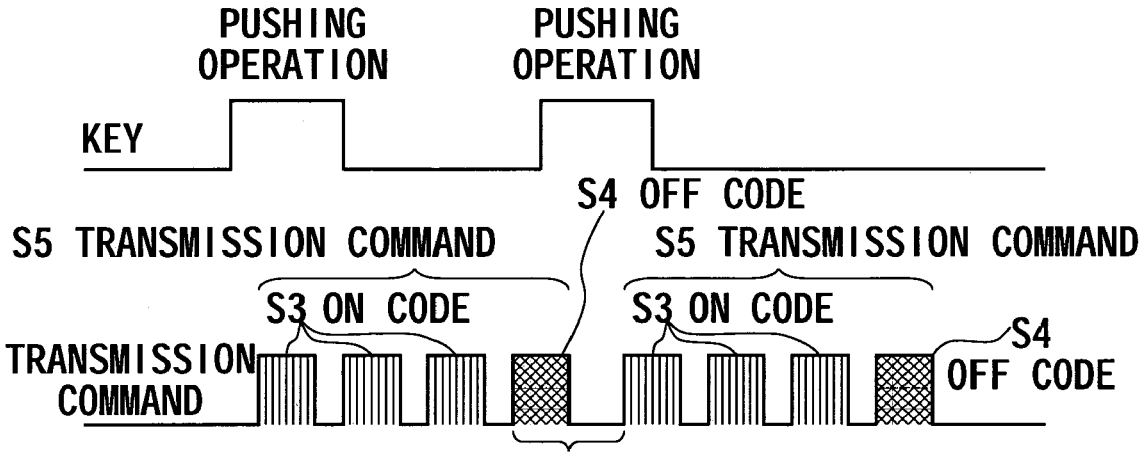
FIG. 11 is a schematic diagram illustrating transmission commands generated when operation of pushing a remote controller key is performed twice within a slightly short period of time.

(2-4) Transmission Commands Generated When Operation of Pushing Remote Controller Key is Performed Twice Within a Slightly Short Period of Time As shown in FIG. 11, in a case in which first pushing operation of the remote controller key 2 generates a first transmission command S5 based on the detection results S2A and S2B from the ON/OFF detection section 3; and then second pushing operation of the remote controller key 2 generates a second transmission command S5 based on the detection results S2A and S2B from the ON/OFF detection section 3 after the transmission of the first transmission command S5 is completed, the second transmission command S5 corresponding to the second pushing operation of the remote controller key 2 comes a few moments after the first transmission command S5 corresponding to the first pushing operation of the remote controller key 2.

In this case, even if the interval between the OFF code S4 in the first transmission command S5 and the first ON code S3 in the second transmission command S5 is for example less or equal to 100 msec, the personal computer (a receiver of the transmission command) detects the OFF code S4 in the first transmission command S5 and subsequently detects the OFF code S4 in the second transmission command S5. This allows the personal computer to correctly recognize two transmission commands S5 transmitted from the infrared remote controller 10.

(3) Configuration of Personal Computer

As shown in FIG. 12, a personal computer 20, which receives the infrared signal S7 from the infrared remote controller 10, receives the infrared signal S7 by an infrared receiving section 21 including phototransistors, and then supplies the infrared signal S7 to a demodulation section 22 as a received light signal S11.

The demodulation section 22 demodulates the received light signal S11 in a predetermined demodulation manner which corresponds to the modulation manner of the modulation section 5 of the infrared remote controller 10 (FIG. 7). The demodulation section 22 then decodes a resulting signal to generate a reception command S12 corresponding to the original transmission command S5 (FIG. 7). The demodulation section 22 subsequently supplies the reception command S12 to an ON code/OFF code detection section 23.

The ON code/OFF code detection section 23 utilizes a timer counter 24 to determine whether or not the intervals between the codes (the ON codes S3 of the reception command S12, and the ON code S3 and subsequent OFF code S4 of the reception command S12) are less or equal to 100 msec. Based on the result, the ON code/OFF code detection section 23 performs code determination process described below. This determines validity of the reception command S12. The ON code/OFF code detection section 23 then supplies a determination result S13 to a Central Processing Unit (CPU) 25. In response to the determination result S13, the CPU 25 performs various processes such as the validity code process and the code invalidity process.

(4) Code Determination Process

Figure 13:
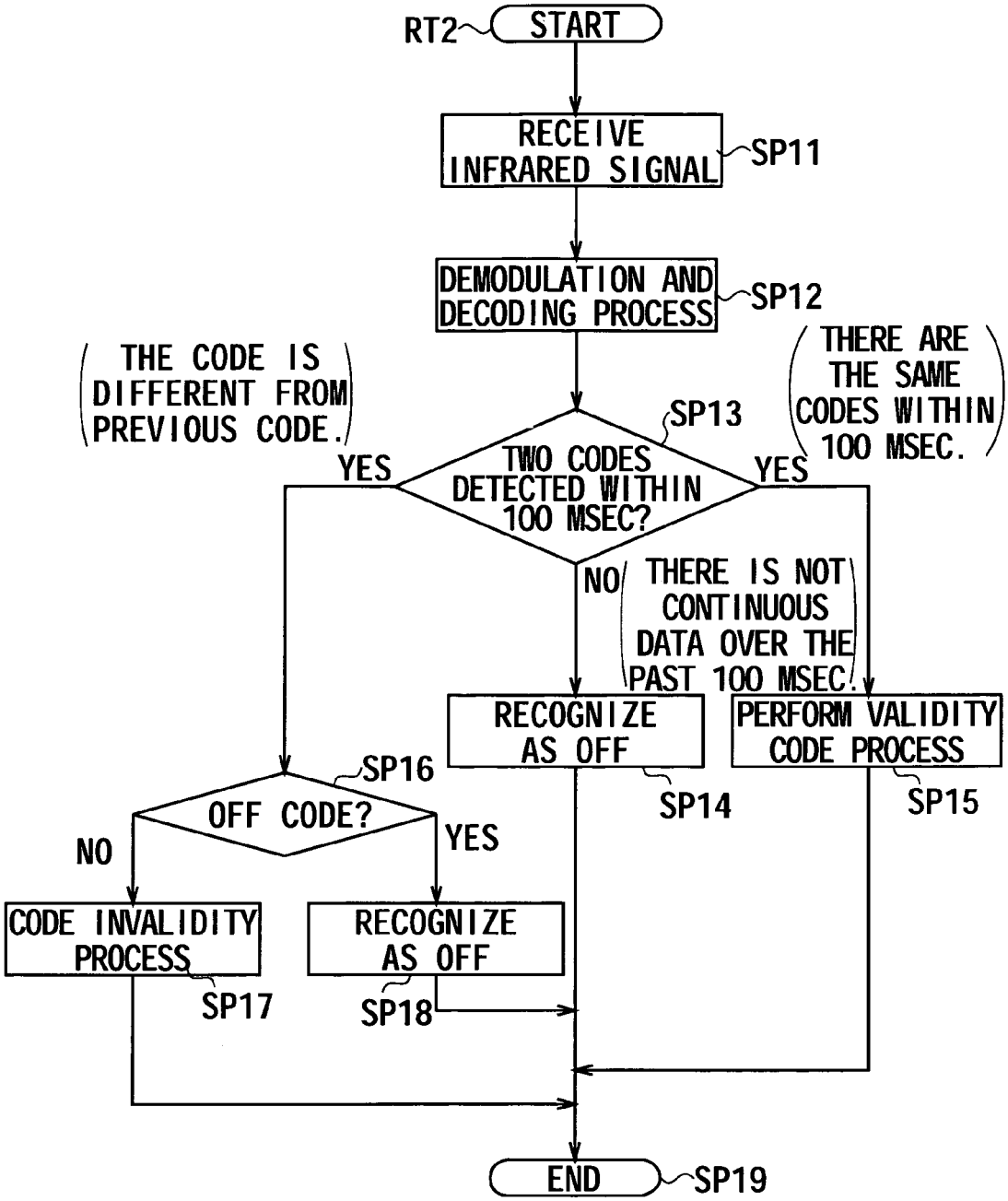
FIG. 13 is a flowchart illustrating code determination process according to an embodiment of the present invention.

To determine the validity of the above-noted reception command S12, the personal computer 20 runs a code determination program stored in a hard disk or a ROM. With reference to FIG. 13, the code determination process will be described below.

The personal computer 20 starts routine RT2 at start step, and then proceeds to step SP11. At step SP11, when the infrared receiving section 21 receives the infrared signal S7 from the infrared remote controller 10, the personal computer 20 proceeds to next step SP12.

At step SP12, the personal computer 20 demodulates and decodes the infrared signal S7 to generate the reception command S12 which corresponds to the transmission command S5 generated at the infrared remote controller 10. The personal computer 20 subsequently proceeds to next step SP13.

At step SP13, the personal computer 20 utilizes the timer counter 24 to determine whether or not the intervals between the codes (the ON codes S3 of the reception command S12, and the ON code S3 and subsequent OFF code S4 of the reception command S12) are less or equal to 100 msec. The personal computer 20 proceeds to next step SP14 when negative result is obtained at step SP13.

At step SP14, since the interval between the codes in the reception command S12 is more than 100 msec, the personal computer 20 accepts the reception command S12 as an OFF state, and therefore proceeds to next step SP19 without performing any process. At step SP19, the personal computer 20 ends the process.

By contrast, in a case in which affirmative result is obtained at step SP13 and two of the same codes are found within the code-reception period of 100 msec, the personal computer 20 proceeds to next step SP15. In a case in which affirmative result is obtained at step SP13 and two of different codes are found within the code-reception period of 100 msec, the personal computer 20 proceeds to next step SP16.

At step SP15, since the personal computer 20 has received two ON codes S3, which are part of the plurality of ON codes S3 of the reception command 12, within the code-reception period of 100 msec, the personal computer 20 accepts the reception command S12 as valid, and therefore performs the predetermined validity code process. The personal computer 20 subsequently proceeds to next step SP19 to end the process.

At step SP16, the personal computer 20, which has received two codes within the period of 100 msec, determines whether or not a second code which has come after a first code (an ON code S3) is an OFF code S4.

Negative result at step SP16 means that the code that came after the ON code S3 is not an OFF code S4 or the same kind of the ON code S3. In this case, the personal computer 20 accepts the reception command S12 as invalid, and therefore performs the code invalidity process. The personal computer 20 subsequently proceeds to next step SP19 to end the process.

By contrast, affirmative result at step SP16 means that the first one of the two codes received within the period of 100 msec is an ON code S3 and the second one is an OFF code S4. Based on this OFF code S4, the personal computer 20 recognizes that the remote controller key 2 has been pushed once, and then proceeds to next step SP19 to end the process.

(5) Operation and Effect

Based on the detection result S2A supplied from the ON/OFF detection section 3 in response to user's operation of pushing the remote controller key 2, the micro computer 11 of the infrared remote controller 10 with the above configuration generates the ON codes S3, and at the same time the micro computer 11 generates the OFF code S4 based on the detection result S2B. The micro computer 11 then generates the transmission command S5 in which the ON codes S3 and the OFF code S4 continuously appear at intervals of approximately 50 msec.

Accordingly, even if a user pushes the remote controller key 2 twice within a very short period of time (such as double-click operation or skipping operation, for example), the micro computer 11 of the infrared remote controller 10 adds the OFF code S4 to the end of each transmission command S5 (i.e., the first transmission command S5 and the second transmission command S5) as shown in FIG. 10.

In this manner, the infrared remote controller 10, which transmits one transmission command S5 each time a user pushes the remote controller key 2 once, adds the OFF code S4 to each transmission command S5. This helps the personal computer 20 recognize each transmission command S5.

For example, the personal computer 20 analyzes the reception commands S12 corresponding to the plurality of the transmission commands S5, which were obtained by demodulating and decoding the infrared signal S7 received from the infrared remote controller 10. Even if the interval between the codes (the ON codes S3 and the OFF code S4) in the reception command S12 corresponding to the first transmission command S5 and the codes (the ON codes S3 and the OFF code S4) in the reception command S12 corresponding to the second transmission command S5 is approximately 50 msec, the personal computer 20 can correctly recognize the number of the transmission commands S5 transmitted from the infrared remote controller 10 by detecting the OFF codes S4 in the reception commands S12.

The personal computer 20 can recognize in the same way even if the interval between the first transmission command S5 and the second transmission command S5 is less or equal to 100 msec as shown in FIG. 11. The infrared receiving section 21 of the personal computer 20 can correctly recognize the number of the transmission commands S5 transmitted from the infrared remote controller 10 by detecting the OFF codes S4.

Compared to the general method where a computer detects one transmission command by determining whether or not the intervals between the ON codes S3 are less or equal to 100 msec, the infrared receiving section 21 can detect one transmission command S5 when detecting the OFF code S4 coming after the ON code S3. This reduces the time needed to detect the transmission commands S5, and therefore enables the CPU 25 to run user's desired process immediately after he/she pushes the remote controller key 2.

On the other hand, the micro computer 11 of the infrared remote controller 10 generates the transmission command S5 by adding the OFF code S4 to the usual ON codes S3. Therefore, the general personal computers capable of recognizing only the ON codes S3 also can accept that transmission command S5. This ensures compatibility between the general personal computers and the infrared remote controller 10 according to an embodiment of the present invention.

In addition, the infrared remote controller 10 is different from the one (disclosed in Patent Document 1) which utilizes remote-controller output having a data section including a remote controller key's key code and additional key-ON/OFF information. That is to say, the infrared remote controller 10 just adds the OFF code S4 without changing the original ON codes S3. Therefore, by just adding a software component of the OFF code additional generation section 12 to the infrared remote controller 10 (without increasing the complexity of the infrared remote controller 10), the infrared remote controller 10 can generate the transmission command S5 by which the personal computer 20 can recognize what kind of key operations are performed to the remote controller key 2.

The infrared remote controller 10 with the above configuration generates the transmission command S5 in which the OFF code S4 is added to the ON codes S3. This ensures compatibility between the infrared remote controller 10 and the general personal computers. In addition, the personal computer 20 can correctly recognize that what kind of pushing operation is performed to the remote controller key 2.

Therefore, the personal computer 20 can correctly recognize that the number of the transmission commands S5 transmitted from the infrared remote controller 10, which is to say the personal computer 20 can correctly recognize how many times a user pushed the remote controller key 2. Accordingly, the personal computer 20 can provide a user with the processing result reflecting his/her intention through the infrared remote controller 10.

(6) Other Embodiments

In the above-noted embodiments, the infrared remote controller 10 generates at least three ON codes S3 each time the remote controller key 2 is pushed once. However, the present invention is not limited to this. If reliability is not demanded, the infrared remote controller 10 may generate one ON code S3. If reliability is demanded, the infrared remote controller 10 may generate at least five ON codes S3. The number of the ON codes S3 to be generated may be set arbitrarily.

In addition, in the above-noted embodiments, the infrared remote controller 10 generates one OFF code S4 and then adds the OFF code S4 after the last ON code S3. However, the present invention is not limited to this. To deal with transmission loss, the infrared remote controller 10 may add a plurality of OFF codes S4 after the last ON code S3.

Furthermore, in the above-noted embodiments, the infrared remote controller 10 adds the OFF code S4 having twenty bits to the ON code S3 having three bits. However, the present invention is not limited to this. The infrared remote controller 10 may generate an OFF code S4 having more (or less) bits than the above OFF code S4, such as an OFF code S4 having three bits which is the same as the ON code S3.

Furthermore, in the above-noted embodiments, the infrared remote controller 10 generates the transmission command S5 in which the ON codes S3 and the OFF code S4 continuously appear at intervals of approximately 50 msec. However, the present invention is not limited to this. The infrared remote controller 10 may generate a transmission command S5 in which the ON codes S3 and the OFF code S4 continuously appear at various intervals such as 30 msec and 70 msec.

Furthermore, in the above-noted embodiments, the personal computer 20 determines whether or not the code-reception interval between the codes (the ON codes S3, and the ON code S3 and subsequent OFF code S4) is less or equal to 100 msec. However, the present invention is not limited to this. To improve the reliability, the personal computer 20 may determine whether or not the code-reception interval between the codes (the ON codes S3, and the ON code S3 and subsequent OFF code S4) is less or equal to 120 msec, 150 msec, or other period of time.

Furthermore, in the above-noted embodiments, a receiver of the transmission command is the personal computer 20. However, the present invention is not limited to this. General television apparatus may be a receiver of the transmission command.

Furthermore, in the above-noted embodiments, the infrared remote controller 10, which is equivalent to a remote controller, includes the ON/OFF detection section 3, which is equivalent to a detection section; the ON code generation section 4, which is also equivalent to the detection section; the OFF code additional generation section 12, which is equivalent to an OFF code additional generation section; the modulation section 5, which is equivalent to a transmission section; and the infrared transmission section 6, which is also equivalent to the transmission section. However, the present invention is not limited to this. The infrared remote controller 10 may include other kinds of hardware components which are equivalent to the detection section, the OFF code additional generation section and the transmission section (The transmission section may perform wireless communication with the Bluetooth (Registered Trademark) protocol and other protocols such as Institute of Electrical and Electronics Engineers (IEEE) 802.11g).

Furthermore, in the above-noted embodiments, the infrared receiving section 20 of the personal computer, which is equivalent to command receiving apparatus, includes the infrared receiving section 21, which is equivalent to a receiving section; the timer counter 24, which is equivalent to a reception interval measurement section; and the ON code/OFF code detection section 23, which is equivalent to a determination section and a command content recognition section. However, the present invention is not limited to this. The personal computer, which is equivalent to the command receiving apparatus, may include other kinds of components which are equivalent to the receiving section, the reception interval measurement section, the determination section and the command content recognition section.

The remote controller, command transmission method, command receiving apparatus and personal computer apparatus according to an embodiment of the present invention can be utilized to remote control various kinds of electronics devices (such as a television, a radio receiver, a Compact Disc (CD) player, a Digital Versatile Disc (DVD) player, an air conditioner, a cell phone, a Personal Digital Assistant (PDA), and a car navigation system) by a remote controller.

It should be understood by those skilled in the art that various modifications, combinations, sub-combinations and alterations may occur depending on design requirements and other factors insofar as they are within the scope of the appended claims or the equivalents thereof.

What is claimed is:

1. A command receiving apparatus comprising:

a receiving section for receiving from a remote controller a transmission command generated by adding a predetermined OFF code to a plurality of continuous ON codes of the same form;

a reception interval measurement section for measuring a code-reception interval, a code-reception interval including an interval between said plurality of continuous ON codes of the same form and an interval between said ON code and said OFF code;

a determination section for determining whether or not said code-reception interval is within a predetermined criterion time;

a command content recognition section for recognizing said transmission command as an OFF state if a determination result by said determination section shows that said code-reception interval is out of said criterion time, recognizing said transmission command as an ON state if the determination result by said determination section shows that said code-reception interval is within said criterion time and two continuous codes are the same kind of said ON code, and recognizing said transmission command as the OFF state if the determination result by said determination section shows that said code-reception interval is within said criterion time and two continuous codes are said ON code and subsequent said OFF code.

2. The command receiving apparatus according to claim 1, wherein said command content recognition section recognizes said transmission command as an invalid code if said code-reception interval is within said criterion time and two continuous codes are different kinds of said ON code.

3. A personal computer apparatus comprising:

a receiving section for receiving from a remote controller a transmission command generated by adding a predetermined OFF code to a plurality of continuous ON codes of the same form;

a reception interval measurement section for measuring a code-reception interval, said code-reception interval including an interval between said plurality of continuous ON codes of the same form and an interval between said ON code and said OFF code;

a determination section for determining whether or not said code-reception interval is within a predetermined criterion time;

a command content recognition section for recognizing said transmission command as an OFF state if a determination result by said determination section shows that said code-reception interval is out of said criterion time, recognizing said transmission command as an ON state if the determination result by said determination section shows that said code-reception interval is within said criterion time and two continuous codes are the same kind of said ON code, and recognizing said transmission command as the OFF state if the determination result by said determination section shows that said code-reception interval is within said criterion time and two continuous codes are said ON code and subsequent said OFF code.

* * * * *